United States Patent [19]

Whipple

[11] Patent Number: 5,076,525

[45] Date of Patent: Dec. 31, 1991

[54] ANTI-TIP APPARATUS FOR APPLIANCES

[75] Inventor: Robert Z. Whipple, Prospect, Ky.

[73] Assignee: General Electric Company, Louisville, Ky.

[21] Appl. No.: 571,686

[22] Filed: Aug. 23, 1990

[51] Int. Cl.[5] ..... A47F 5/00

[52] U.S. Cl. ..... 248/300; 248/500; 248/680

[58] Field of Search ..... 248/300, 301, 220.1, 248/500, 680, 154, 224.4; 312/245

[56] References Cited

U.S. PATENT DOCUMENTS

| | | | |
|---|---|---|---|
| 497,015 | 5/1893 | Conde . | |
| 976,397 | 11/1910 | Roberts . | |
| 1,313,307 | 8/1919 | Locraft . | |
| 1,426,762 | 8/1922 | Nott | 248/680 |
| 1,450,183 | 4/1923 | Moon . | |
| 2,651,483 | 9/1953 | Ritchie et al. . | |
| 4,076,204 | 2/1978 | Kalka | 248/500 |
| 4,088,293 | 5/1978 | Delmore | 248/500 |
| 4,660,793 | 4/1987 | Mark | 248/224.4 X |
| 4,669,695 | 6/1987 | Chou | 248/680 X |
| 4,754,948 | 7/1988 | Casciani | 248/680 |
| 4,840,343 | 6/1989 | Gasser | 248/500 |
| 4,858,878 | 8/1989 | Gassaway | 248/680 X |
| 4,878,645 | 11/1989 | O'Neill | 248/680 |
| 4,890,813 | 1/1990 | Johnson et al. | 248/680 |

*Primary Examiner*—Ramon O. Ramirez

*Attorney, Agent, or Firm*—H. Neil Houser; Radford M. Reams

[57] ABSTRACT

An improved anti-tip apparatus for an appliance includes a generally L-shaped retaining bracket which mounts to the wall adjacent the appliance with one leg projecting forwardly to engage a retaining edge in the rear of the appliance. A downwardly extending hook member at the free end of the appliance engaging leg prevents the retaining edge from sliding off of the end of the retaining leg in the event of upward movement of the retaining edge as might result from forward tipping motion of the appliance.

13 Claims, 2 Drawing Sheets

ANTI-TIP APPARATUS FOR APPLIANCES

BACKGROUND OF THE INVENTION

This invention relates to apparatus for preventing the accidental tip-over of free-standing structures such as domestic home appliances.

In free-standing electric or gas ranges, the oven door is hinged at its bottom edge and pivots downwardly approximately 90° from a vertical closed position to a horizontal open position. In the open position the door may extend parallel to the floor at a height of several inches to a foot above floor level. In this position it is possible for objects to be placed on the door of sufficient weight to cause the appliance to tilt forward, and possibly to tip completely over.

One approach to this problem is described and claimed in commonly assigned U.S. Pat. No. 4,669,695 to Chou. In this arrangement a pair of rigid brackets are mounted to the wall behind the appliance and project forward to be received in corresponding apertures in the rear of the appliance. Each support member is positioned to engage the lower edge of its respective aperture to limit tipping of the appliance when positioned adjacent the wall. The wall engaging portion of each bracket has a length greater than the distance between wall frame members to insure attachment to a frame member. This arrangement has been demonstrated to work satisfactorily. However, the brackets are relatively large to provide the necessary length and rigidity in the portion which engages the appliance and to provide the desired mounting versatility, rendering the approach relatively costly.

U.S. Pat. No. 4,754,948 to Casciani discloses an alternative approach in which a pair of U-shaped brackets are disposed proximate to the intersection of wall and floor with the vertically extending bight attached to the wall and one leg attached to the floor. The free leg projects forward to extend into an aperture formed in the rear cabinet wall of the appliance. The U-shaped brackets must be rigid enough and long enough to prevent the tipping movement of the appliance from causing it to slide off of the retaining arm. In addition, a pair of brackets is required. In an alternative arrangement therein disclosed, a pair of rearwardly extending projections are secured to the rear of the appliance to extend into corresponding holes drilled in the wall behind the appliance. This use of projections extending from the appliance presents obvious alignment problems rendering installation difficult.

In view of the limitations of the foregoing prior art, it is a primary object of the present invention to provide an improved anti-tip apparatus for appliances which is easy to install initially and which facilitates removal and reinstallation such as for cleaning around or servicing the appliance, and which is relatively inexpensive.

SUMMARY OF THE INVENTION

This and other objects of the invention are achieved in accordance with the present invention, by anti-tip apparatus for an appliance to be located proximate a wall, comprising a generally L-shaped retaining bracket, with a wall engaging leg adapted for flush mounting to the wall adjacent the appliance and an appliance engaging leg projecting forwardly to engage the appliance. A retaining edge is provided in the appliance adapted to extend beneath the appliance engaging leg for abutting engagement with the leg in the event of upward movement of the retaining edge as might result from forward tipping motion of the appliance. Stop means provided proximate the free end of the appliance engaging leg, preferably in the form of an integrally formed downwardly extending hook member, limits the forward lateral motion of the retaining edge on the appliance relative to the appliance engaging leg, to prevent the retaining edge from sliding off of the end of the retaining leg. This permits the leg to be shorter and somewhat less rigid than a similar bracket would need to be without the hook thereby reducing material costs. In addition, the reliable retaining action of the stop means eliminates the need for a second bracket, further reducing the cost.

One form of the invention contemplates a mounting bracket attachable to the appliance to provide the retaining edge. Alternatively, the retaining edge may be the bottom edge of an aperture formed in the appliance cabinet wall to receive the engaging leg.

In accordance with a further aspect of the invention, the bracket comprises a channel member of generally "W" shaped lateral cross-section. The outer side walls are flared outwardly in the wall engaging leg to accommodate additional width of material for enhanced rigidity while meeting height limitations imposed by constraints on clearance requirements between the appliance and the adjacent structural wall. In the appliance engaging leg the outer side walls are essentially parallel to reduce width, thereby providing greater lateral dimensional tolerance in engaging the appliance.

In accordance with a preferred form of the invention, the retaining bracket is positioned with the free end of the wall engaging leg abuttingly engaging the floor proximate the intersection of wall and floor. The bracket is secured in position by fastening means such as a wood screw which passes through an aperture in the wall engaging leg. The aperture is angled downward to facilitate securing the wood screw to the toe plate of the wood frame supporting the structural wall. In this way, secure anchoring of the bracket to the wood frame structure is assured without lateral restriction on location of the appliance.

BRIEF DESCRIPTION OF THE DRAWINGS

Although the novel features of the invention are set forth with particularity in the appended claims, the invention both as to organization and content will be better understood and appreciated from the following detailed description taken in conjunction with the drawings in which:

DETAILED DESCRIPTION

The embodiment hereinafter described illustrates use of the anti-tipping apparatus of the present invention in a free-standing electric range appliance. However, it will be appreciated that advantageous use of the invention is not limited to such appliances but could find application to other free-standing cabinet structures installed adjacent a wall as well.

Figure 1:
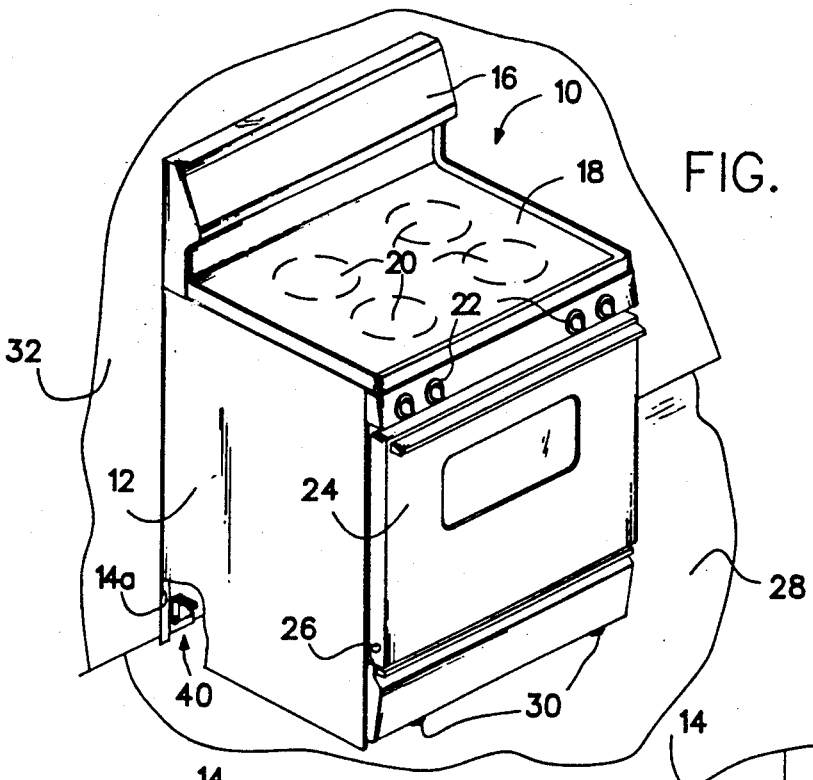
FIG. 1 is a perspective view showing a cooking range with portions removed to show an illustrative embodiment of the associated anti-tip apparatus in accordance with the present invention.
Figure 2:
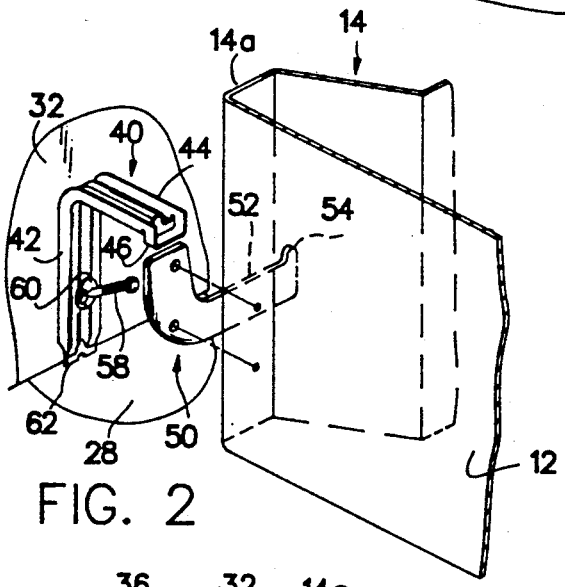
FIG. 2 is a fragmentary perspective view showing the anti-tip apparatus of FIG. 1 prior to cooperative assembly.
Figure 3:
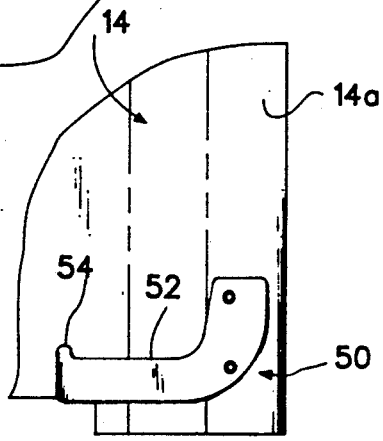
FIG. 3 is a fragmentary rear view of the range of FIG. 1 showing the mounting bracket portion of the anti-tip apparatus attached to rear wall of the range cabinet.

Turning now to the drawings and in particular to FIG. 1, there is shown for illustrative purposes a cooking range 10 incorporating an illustrative embodiment of the anti-tip apparatus of the present invention. Range 10 includes an outer cabinet comprising side walls 12, and a rear wall 14. Range 10 includes a control panel 16, for various components such as clock displays and oven controls (not shown). The cooktop surface 18 accommodates surface heating units which can be electric or gas, illustrated schematically at 20. Control knobs 22 permit user selection of heating levels for surface units 20.

Oven door 24 covers the access opening to an oven cavity (not shown) within the outer cabinet. Door 24 is pivoted at its lower edge about point 26. Door 24 is movable to an open position rotated approximately 90° extending parallel to the support floor 28. Appliance 10 is supported from floor 28 by adjustable levelling legs 30.

The present invention contemplates improved anti-tip apparatus to prevent the accidental tip-over of appliances operationally installed adjacent to structural walls. Such apparatus may be particularly advantageously applied in settings in which the structural walls are of conventional hollow wall construction in which dry wall sheeting is attached to vertical frame members or studs supported from horizontal frame members or toe plates.

In the illustrative embodiment herein described, the anti-tip apparatus of the present invention includes retaining bracket 40, of generally inverted L-shape adapted for mounting to an adjacent structural wall 32 and means for providing a cooperative retaining edge on the adjacent appliance cabinet wall which in the illustrative embodiment is rear cabinet wall 14.

Bracket 40 includes a wall engaging leg 42 which is adapted to be secured to structural wall 32 and an appliance engaging leg 44 projecting forwardly to cooperatively engage the retaining edge of the appliance to prevent tip-over. The ability of bracket 40 to reliably limit the tipping movement of the range is substantially enhanced relative to a simple angle bracket by hook 46, provided at the free end of appliance engaging leg 44. Hook 46 extends vertically downwardly relative to the leg 44 to provide a positive stop for retaining edge 52, thereby preventing the retaining edge from sliding off of the end of engaging leg 44 due to tipping movement of the range.

In the embodiment of FIGS. 2-5, the retaining edge is provided on the appliance by a mounting bracket 50 comprising a flat sheet metal stamping which is attached by suitable means such as sheet metal screws to the rearmost portion 14*a* of rear cabinet panel 14 and extends in front of the recess formed by rear panel 14 to accommodate gas or electric range connections. Upper edge 52 of bracket 50 forms a retaining edge which extends beneath leg 44 of bracket 40 when range 10 is properly positioned adjacent wall 32. Mounting bracket 52 includes a vertical projection 54 near its free end which limits the lateral movement of leg 44 relative to the restraining edge 52 when tipping of the range moves edge 52 into engagement with leg 44.

Figure 4:
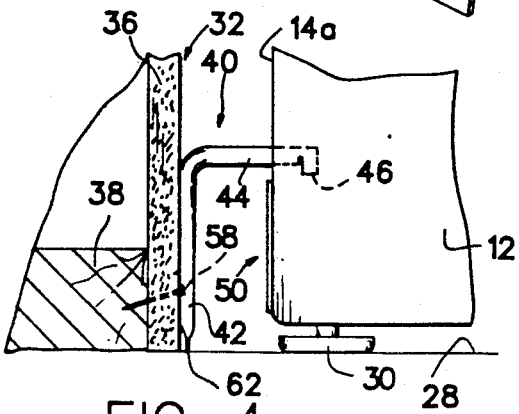
FIG. 4 is a simplified schematic fragmentary side elevational view of the range of FIG. 1 showing the anti-tip apparatus after cooperative assembly with the range in its normal operating position.
Figure 5:
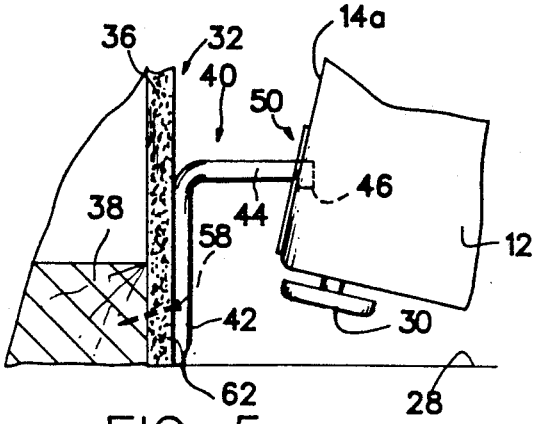
FIG. 5 is a simplified schematic fragmentary view similar to FIG. 4 showing the range in tipped position.
Figure 6:
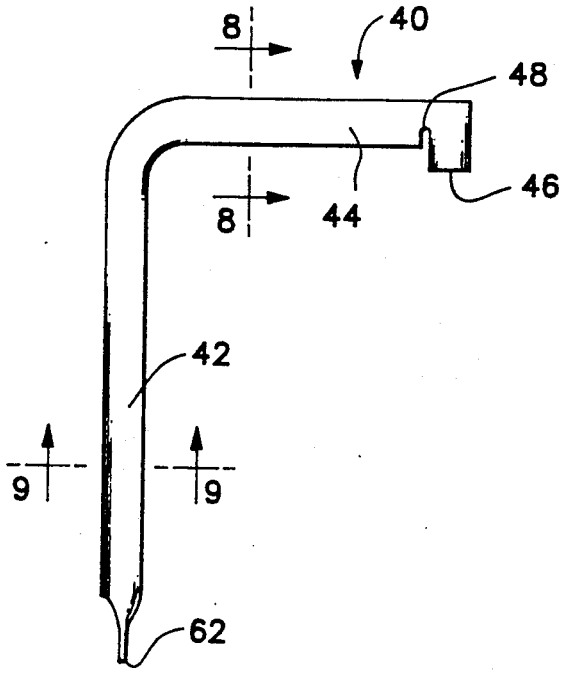
FIG. 6 is a side elevational view of the retainer bracket portion of the anti-tip apparatus of FIG. 1.
Figure 7:
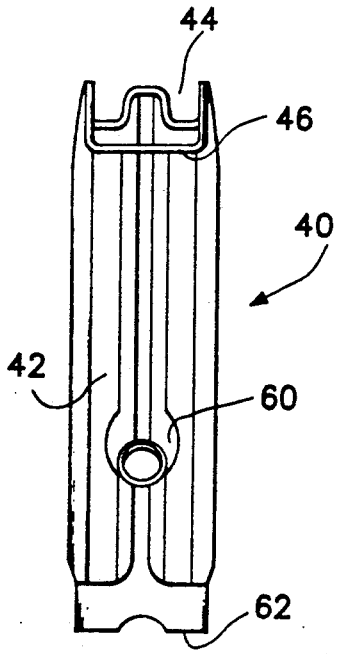
FIG. 7 is a front elevational view of the retainer bracket of FIG. 6.

As best seen in FIGS. 1, 4 and 5, when range 10 is in its normal operating position, appliance engaging leg 44 projects into the recess area behind range 10 with the retaining edge 52 on mounting bracket 50 extending beneath leg 44. Vertical spacing is provided between leg 44 and retaining edge 52 sufficient to accommodate adjustment of appliance height via adjustable leveling legs 30. Forward tipping movement of the range such as might occur by placing a heavy object on door 24 in its open position moves retaining edge 52 into engagement with leg 44 as shown in FIG. 5. This tipping motion typically generates a sliding action between leg 44 and edge 52. In addition the upward force applied to leg 44 by edge 52 generates some plastic deformation, i.e. upward bending of leg 44 which can magnify the sliding effect. Hook 46 halts the sliding action by providing a vertical surface which catches the retaining edge 52. Hook 46 enables retaining bracket 40 to prevent tipping with substantially greater loads on the oven door than would otherwise be achievable with a comparable gauge metal bracket. In addition, the length of leg 44 can be less than would be required to provide comparable reliability without hook 46.

In a preferred configuration of the anti-tip apparatus of the present invention the wall engaging leg 42 of bracket 40 is secured in place by a wood screw 58 which projects through a countersunk aperture 60 in leg 42. The length of screw 58 is such as to enable the screw to pass completely through the wall board 36 and project a sufficient distance into the toe plate 38 supporting the wall to securely mount bracket 40 using a single screw. Countersunk aperture 60 is angled downward at an angle of approximately 20° from horizontal to facilitate installation and make sure screw 58 enters toe plate 38 when the bracket 40 is properly mounted with the free end 62 of the wall engaging leg 42 abuttingly engaging floor 28 proximate the intersection of floor 28 and wall 34. In the illustrative embodiment a No. 12 wood screw on the order of 2 inches long has provided satisfactory results.

Figure 9:
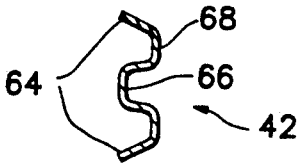
FIG. 9 is a sectional view of the bracket of FIG. 6 taken along lines 9—9.
Figure 8:
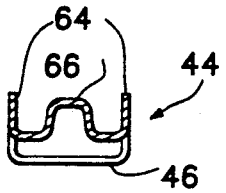
FIG. 8 is a sectional view of the bracket of FIG. 6 taken along lines 8—8.

The retaining bracket 40 will be described in greater detail with reference to FIGS. 6-9, which show bracket 40 removed from the wall. Bracket 40 is integrally formed from G090 galvanized steel preferably on the order of 0.040 inches thick by stamping. As best seen in FIG. 9, the lateral cross-section of wall engaging leg 42 comprises a channel member having a W-shaped lateral cross-section with the outer channel walls 64 flared outwardly such that the side walls 64 and the central region 66 flushingly engage the mounting surface. In the appliance engaging leg 44 these outer walls 64 are narrowed to be parallel, providing a narrower width to permit somewhat greater lateral tolerance when engaging the retaining edge in the appliance.

The total surface width of the metal strip comprising the bracket and the general corrugated W cross section are selected to provide the necessary rigidity. However, the allowable height of wall engaging leg 42 as measured from the wall to surface 68 of leg 42 is dictated by the allowable clearance between the structural wall and the appliance. In order to reconcile such clearance requirements with the required surface width of the strip, the height of the middle portion 66 of bracket 40 is selected to meet the clearance requirement. The additional height to meet the surface width requirement is taken up in the outer walls 64 of the bracket, resulting in the height of the outer walls 64 exceeding the height of the middle portion 66. The outer walls 64 of wall engaging leg 42 are flared outward to enable the vertical height of the outer edges to equal the height of the middle portion so as to mount flush to the wall. In the appliance engaging leg 44, the dimensional constraints are bracket width rather than height. Hence, in this leg the outer sides 64 of the bracket are parallel to provide the maximum side to side tolerance in engaging the retaining edge on the range.

Hook 46 is formed by notching out a portion of the sheet metal to permit forming of the hook without stretching the metal thereby achieving a greater degree of structural strength for the hook. The length and width of hook 46 together with the depth of notch 48 are selected to assure that hook 46 will withstand loading requirements.

Near the free end 62 of wall engaging leg 42 the W-shaped cross-section tapers to a flat. This has no bearing on the function or manner of operation of the anti-tip apparatus. Rather, it facilitates the fabrication process in which brackets 40 are formed in pairs joined at the flat. The flat permits a clean cut to separate the pair.

Figure 10:
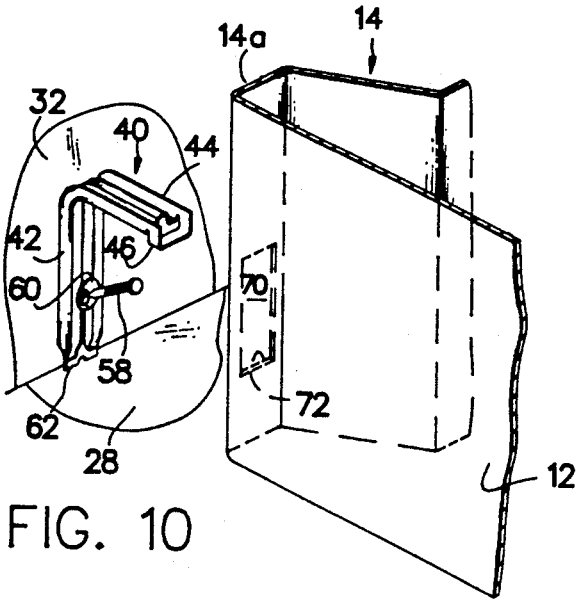
FIG. 10 is a fragmentary perspective view showing an alternative embodiment of the anti-tip apparatus in accordance with the present invention in a range otherwise identical to the range of FIG. 1.
Figure 11:
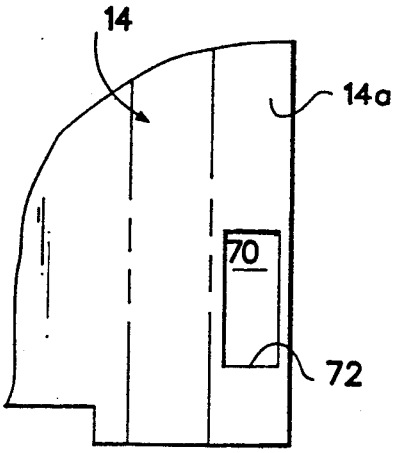
FIG. 11 is a fragmentary rear elevated view of the range of FIG. 10 showing an aperture formed in the rear wall of the range as part of the anti-tip apparatus.

An alternative embodiment of the anti-tip apparatus is partially illustrated in FIGS. 10 and 11. In this embodiment retainer bracket 40 is identical to that hereinbefore described. However, mounting bracket 50 is replaced by an aperture 70 cut in the rearmost portion **14*a* of rear wall 14. The bottom edge 72 of aperture 70 forms the retaining edge. When fully assembled in the normal operating position, leg 44 of retainer bracket 40 projects through aperture 70. The structural integrity of the portion of wall 14*a* forming the edge 72 beneath aperture 70 is enhanced by its proximity to the corner bends which define wall portion 14*a***.

In the illustrative embodiments hereinbefore described, the appliance is installed with its rear wall adjacent a structural wall. In some settings the appliance may be installed with the structural wall adjacent a side wall or panel of the appliance rather than the rear wall. In such settings the anti-tip apparatus of the invention could be applied by mounting retaining bracket 40 to the structural wall to cooperatively engage a retaining edge formed in the side wall of the cabinet. Alternatively, mounting bracket 50 could be attached to the appliance side panel to extend rearwardly therefrom beneath leg 44 of bracket 40 which in this configuration would project from the structural wall into the region directly behind the appliance cabinet proximate the rear corner of the appliance cabinet.

While in accordance with the Patent Statutes, specific embodiments of the present invention have been illustrated and described herein, it is realized that modifications and changes may occur to those skilled in the art. It is therefore to be understood that the appended claims are intended to cover all such modifications and changes as fall within the true spirit and scope of the invention.

What is claimed is:

1. Anti-tip apparatus for an appliance positioned adjacent a wall, said apparatus comprising:

a single generally L-shaped retaining bracket comprising a wall engaging leg adapted for flush mounting to the wall adjacent the appliance and an appliance engaging leg projecting forwardly therefrom;

a retaining edge provided in the appliance adapted to extend beneath said appliance engaging leg for abutting engagement with said appliance engaging leg when appliance is operatively positioned adjacent the wall, in the event of upward movement of said retaining edge as might result from forward tipping motion of the appliance; and stop means disposed at the free end of said appliance engaging leg operative to limit forward lateral movement of said retaining edge relative to said appliance engaging leg;

whereby in the event forward tipping movement of the appliance causes said retaining edge to abuttingly engage said appliance engaging leg, said stop means is operative upon engagement with said retaining edge to halt further tipping movement of the appliance.

2. Anti-tip apparatus in accordance with claim 1 wherein said stop means comprises hook means projecting downwardly from said appliance engaging leg proximate the free end thereof.

3. Anti-tip apparatus in accordance with claim 1 wherein said retaining edge comprises the upper edge of a bracket member rigidly mounted to the appliance for extension beneath said appliance engaging leg when the appliance is operatively positioned adjacent the wall.

4. Anti-tip apparatus in accordance with claim 1 wherein said retaining edge comprises the lower edge of an aperture formed in the appliance to receive said appliance engaging leg when the appliance is operatively positioned adjacent the wall.

5. Anti-tip apparatus in accordance with claim 1 wherein said retaining bracket is of generally W-shaped lateral cross-section.

6. Anti-tip apparatus in accordance with claim 5 wherein the portion of the bracket forming the outermost legs of the W in said wall engaging portion are flared relative to that of said appliance engaging leg.

7. Anti-tip apparatus for an appliance positioned adjacent a wall, said apparatus comprising:

a single generally L-shaped retaining bracket comprising a wall engaging leg adapted for flush mounting to the wall adjacent the appliance and an appliance engaging leg projecting forwardly therefrom;

a mounting bracket adapted for attachment to the appliance, said mounting bracket having formed therein a retaining edge operative to extend beneath said appliance engaging leg when the appliance is operatively positioned adjacent the wall;

said retaining bracket including stop means integrally formed at the free end of said appliance engaging leg operative to limit forward lateral movement of said retaining edge relative to said appliance engaging leg;

whereby in the event forward tipping movement of the appliance causes said retaining edge to abuttingly engage said appliance engaging leg, and said stop means is operative upon engagement with said retaining edge to prevent any subsequent lateral movement of said retaining edge relative to said leg thereby halting the tipping movement of the appliance.

8. Anti-tip apparatus in accordance with claim 8 wherein said stop means comprises hook means projecting downwardly from said appliance engaging leg proximate the free end thereof.

9. Anti-tip apparatus in accordance with claim 8 wherein said retaining bracket is of generally W-shaped lateral cross-section.

10. Anti-tip apparatus in accordance with claim 10 wherein the portion of the bracket forming the outermost legs of the W in said wall engaging leg are flared relative to that of said appliance engaging leg.

11. Anti-tip apparatus in accordance with claim 8 further comprising fastener means for securing said wall engaging leg of said retaining bracket in engagement with the wall, said fastener means comprising a single screw member and an aperture formed in said wall engaging leg to receive said screw member which when fully assembled passes through said aperture and into the wall.

12. Anti-tip apparatus for an appliance of the type supported from the floor and located adjacent a wall supported from wooden framing including a toe plate, said apparatus comprising:

a single generally L-shaped retaining bracket comprising a wall engaging leg adapted for flush mounting to the wall adjacent the appliance and an appliance engaging leg projecting forwardly therefrom, said wall engaging leg being adapted for flush mounting to the wall adjacent the appliance with the free end thereof abuttingly engaging the floor proximate the intersection of the wall and the floor;

a mounting bracket adapted for attachment to the appliance, said mounting bracket including a retaining edge adapted to extend beneath said appliance engaging leg when the appliance with said mounting bracket properly attached is operatively positioned adjacent the wall;

said retaining bracket including a downwardly extending hook member integrally formed at the free end of said appliance engaging leg operative to limit forward lateral movement of said retaining edge relative to said appliance engaging leg;

whereby forward tipping movement of the appliance causes said retaining edge to abuttingly engage said appliance engaging leg, said hook member being operative upon engagement with said retaining edge to halt lateral movement of said retaining edge relative to said leg thereby halting the tipping movement of the appliance.

13. The anti-tip apparatus of claim 12 further comprising fastener means for securing said wall engaging leg of said retaining bracket in engagement with the wall, said fastener means comprising a single screw member and a screw receiving aperture formed in said wall engaging leg, when fully assembled said screw passes through said aperture and the wall into the toe plate supporting the wall, said screw receiving aperture being countersunk at a downward angle to facilitate engagement of the toe plate by said screw.

* * * * *